US007941869B2

(12) United States Patent
Wright et al.

(10) Patent No.: US 7,941,869 B2
(45) Date of Patent: May 17, 2011

(54) APPAREL WITH REDUCED DRAG COEFFICIENT

(75) Inventors: Steven P. Wright, Beaverton, OR (US); Kenneth T. Craig, Beaverton, OR (US); Richard C. MacDonald, Portland, OR (US); Leonard W. Brownlie, West Vancouver (CA)

(73) Assignee: NIKE, Inc., Beaverton, OR (US)

( * ) Notice: Subject to any disclaimer, the term of this patent is extended or adjusted under 35 U.S.C. 154(b) by 1104 days.

(21) Appl. No.: 11/673,195

(22) Filed: Feb. 9, 2007

(65) Prior Publication Data

US 2008/0189825 A1 Aug. 14, 2008

(51) Int. Cl.

| | |
|---|---|
| ***A41D 13/00*** | (2006.01) |
| ***A41B 11/00*** | (2006.01) |
| ***A43B 17/00*** | (2006.01) |

(52) U.S. Cl. ..... 2/69; 2/239

(58) Field of Classification Search ..... 2/61, 239, 2/240, 241, 242, 22

See application file for complete search history.

(56) References Cited

U.S. PATENT DOCUMENTS

| | | | | | |
|---|---|---|---|---|---|
| 4,972,522 | A | * | 11/1990 | Rautenberg | 2/67 |
| 5,033,116 | A | * | 7/1991 | Itagaki et al. | 2/67 |
| 5,380,578 | A | * | 1/1995 | Rautenberg | 428/172 |
| 5,734,990 | A | * | 4/1998 | Waring | 2/69 |
| 5,842,959 | A | * | 12/1998 | Wilkinson | 482/121 |
| 5,887,280 | A | * | 3/1999 | Waring | 2/69 |
| 6,098,198 | A | * | 8/2000 | Jacobs et al. | 2/69 |
| 6,438,755 | B1 | | 8/2002 | MacDonald et al. | |

FOREIGN PATENT DOCUMENTS

JP 2003-105608 * 4/2003

* cited by examiner

*Primary Examiner* — Gary L Welch
*Assistant Examiner* — Amber R Anderson
(74) *Attorney, Agent, or Firm* — Plumsea Law Group, LLC

(57) ABSTRACT

An athletic garment including a panel designed to reduce frictional and pressure drag around an appendage of an athlete competing in a high-speed event, such as running and cycling. The panel is positioned to encircle the appendage, and is provided with regions having different surface texture roughnesses. The leading edge of the panel includes texture designed to enhance the laminar boundary layer, while the adjacent portion of the panel includes texture intended to trip the boundary layer to turbulent flow. The drag-reducing panel may be the cuff of a sock, a sleeve, wristband, a headband, or the like.

31 Claims, 11 Drawing Sheets

FIG. 29
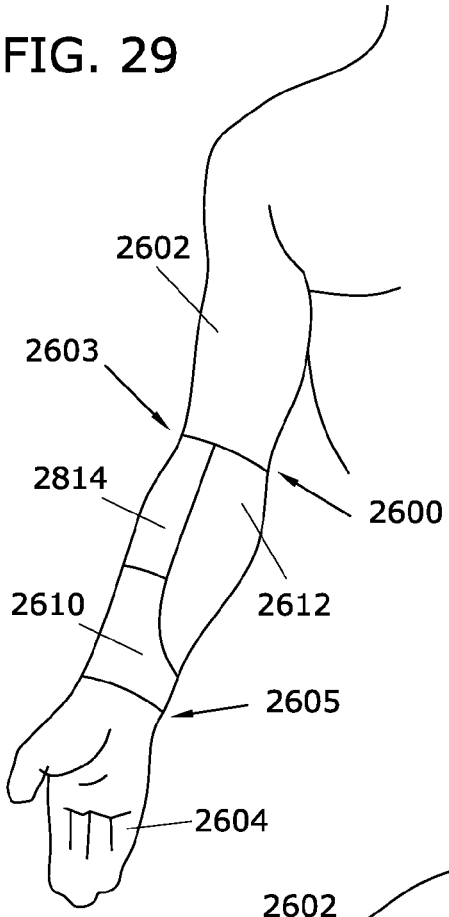
FIG. 30
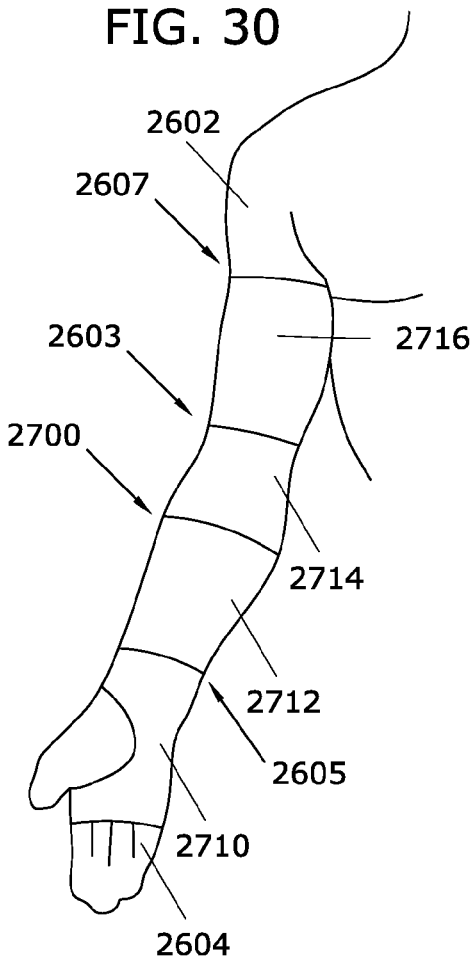
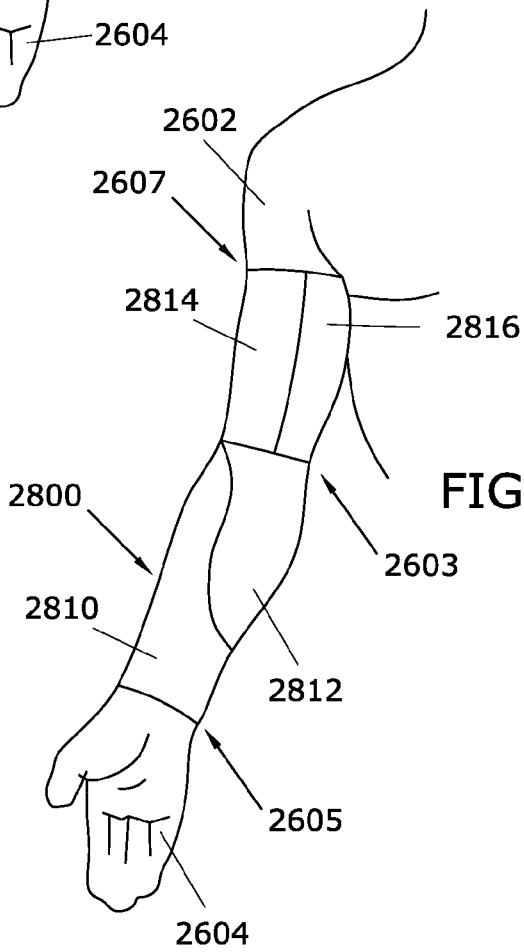
FIG. 31

APPAREL WITH REDUCED DRAG COEFFICIENT

BACKGROUND OF THE INVENTION

1. Field of the Invention

The present invention relates generally to athletic apparel, and in particular to athletic apparel for reducing the drag force on a wearer's appendage.

2. Description of Related Art

In many speed-based individual athletic events, such as bicycling, speed skating, and running, the difference between achieving first or second place is typically a fraction of a second. Individually-controllable factors, such as form and athletic power, are often the focus in the training for reducing performance time in such events. Drag due to the resistance of the movement of an athlete through a fluid such as the air or water is also a contributing factor in increasing performance time.

Any body moving through a fluid experiences a drag force, which may be divided into two components: frictional drag and pressure drag. Frictional drag is due to the friction between the fluid and the surfaces over which the fluid is flowing. The smoother the surface, the less frictional drag is generated by moving through the fluid.

Pressure or form drag derives from the eddying motions that are created by the motion of the body through the fluid, such as the formation of a region of separated flow or "wake" behind the body. The pressure in the wake is typically slightly less than the pressure in front of the body, and in extreme cases of cavitation, is significantly less than the pressure in front of the body. As such, to continue moving forward, the athlete must provide additional force to overcome the imbalance of the pressure forces in front of and behind the athlete.

The drag force on an athlete competing at lower speeds is generally dominated by the frictional component. It is known that improvements in performance times can be obtained by smoothing the surface of an athlete. For example, swimmers and bicyclists have long shaved the hair from legs, arm, and even heads in order to smooth the surface of the exposed skin. This shaving helps to reduce the friction between the athlete and the fluid (air or water) in which the athlete competes to save a fraction of second in performance time.

However, given that the shape of an athlete is not streamlined or optimized for motion through a fluid, the drag force on an athlete competing at high speeds is generally dominated by the pressure drag component. The pressure drag depends on factors such as the density of the fluid in which the athlete is moving, the projected frontal area of the athlete, and the velocity of the athlete. This drag component is generally inflexible, given that the size and operating power of the athlete as well as the density of the fluid in which the athlete operates remains fairly constant. An athlete may assume a crouching position in cycling or skiing to project a smaller frontal area to reduce pressure drag, but little can be done to streamline an athlete's form to reduce drag solely through training.

To decrease the influence of both frictional and pressure drag, athletic apparel and gear have been used to streamline the bodies of athletes. For example, aerodynamically streamlined helmets have been provided for cyclists.

However, with certain types of bluff bodies, such as spheres and cylinders, it has long been known that increasing surface roughness of the bluff body can actually reduce the pressure drag. For example, golf balls with dimples have significantly reduced drag and can travel much further than smooth surface golf balls. A sphere or cylinder with a roughened surface causes the laminar boundary layer to transition to a turbulent boundary layer at a lower velocity than that of a sphere or cylinder with a smooth surface. This turbulent boundary layer inhibits the separation of the fluid flowing around the body, causing the fluid to adhere to the surface contours of the body longer than the fluid would "stick" to a smooth body. As such, the cross-sectional area of the wake formed by the separation of the fluid flowing around the roughened body is smaller than the wake formed by the earlier separation of the same fluid flowing around a similarly-sized and shaped smooth body. For example, on a smooth sphere, using conventional notation with 0 degrees located at the leading edge of the sphere, the flow separation points are located at around 70 degrees and around 290 degrees on the sphere. On a roughened sphere, such as a golf ball with dimples, the turbulent boundary layer formed by the rough surface texture pushes the separation points toward 110 degrees and 250 degrees.

This technology has been applied to apparel worn by high-speed athletes. For example, speed skaters may attach so-called "Z strips" onto otherwise very smooth outfits to create a turbulent boundary layer. Further, U.S. Pat. No. 6,438,755 to MacDonald et al. provides an aerodynamic body suit, where each body segment of the suit is assigned a Reynolds number based upon the size and anticipated velocity of the body segment.

However, in some high speed athletic events, such as cycling, the rules of the sport prohibit the wearing of non-essential garments or garments for the purpose of reducing drag. As such, Z strips and body suits are not available to these athletes. Therefore, a need exists in the art for additional athletic garments with improved aerodynamic characteristics.

SUMMARY OF THE INVENTION

The invention provides a garment comprising a panel substantially encircling an appendage of a wearer, wherein the panel is configured to reduce drag on the appendage of the wearer from an oncoming fluid.

In another aspect, a texture is provided on the panel, the texture configured to transition a flow pattern of the oncoming fluid from laminar flow to turbulent flow.

In another aspect, the texture is woven into the panel.

In another aspect, the texture is affixed to an exterior surface of the panel.

In another aspect, the texture is pressed into the panel.

In another aspect, the texture comprises at least one of straight horizontal ribs, straight vertical ribs, zig-zag vertical ribs, diagonal ribs, or nodules.

In another aspect, a first panel region has a first texture and a second panel region has a second texture.

In another aspect, the first texture is positioned at the leading edge of the appendage.

In another aspect, the first texture comprises parallel ridges positioned substantially parallel to a flow pattern of the oncoming fluid.

In another aspect, the second texture is positioned adjacent to the first texture.

In another aspect, the second texture comprises perpendicular ridges positioned substantially perpendicular to a flow pattern of the oncoming fluid.

In another aspect, the garment comprises a sock.

In another aspect, the panel forms at least a portion of a cuff of the sock.

In another aspect, the garment comprises a sleeve.

In another aspect, the sleeve is configured to be worn on a leg.

In another aspect, the sleeve extends from an ankle region to a knee region.

In another aspect, the sleeve extends from an ankle region to a thigh region.

In another aspect, the sleeve is configured to be worn on an arm.

In another aspect, the sleeve extends from a wrist region to an elbow region.

In another aspect, the sleeve extends from a wrist region to a bicep region.

In another aspect, the sleeve at least partially covers a hand and extends over at least a portion of the arm.

In another aspect, the invention provides an athletic garment comprising: a body configured to receive and substantially cover a foot; a cuff connected to the body; the cuff configured to substantially encircle at least a portion of a leg; a drag-reducing panel connected to the cuff; the drag-reducing panel including a rough region having a first surface texture and a second region having a second surface texture, wherein the rough region is configured to transition a boundary layer of an oncoming flow from laminar flow to turbulent flow.

In another aspect, the drag-reducing panel is integrated with the cuff.

In another aspect, wherein the pattern comprises at least one of a straight horizontal ridge, a straight vertical ridge, a diagonal ridge, a vertical zig-zag ridge, or a nodule.

In another aspect, at one of the first surface texture and the second surface texture comprises a pattern woven into the cuff.

In another aspect, the rough region comprises at least one ridge positioned substantially perpendicular to the oncoming flow.

In another aspect, the second surface texture is configured to maintain the boundary layer as laminar flow.

In another aspect, the second surface texture comprises at least one ridge positioned substantially parallel with the oncoming flow.

In another aspect, a third region is provided adjacent to the rough region, wherein the third region includes a third surface texture configured to maintain the turbulent boundary layer.

In another aspect, the third surface texture comprises a plurality of deep ridges positioned substantially perpendicular to the oncoming flow.

In another aspect, at least one of the first surface texture and the second surface texture comprises a pattern pressed into the cuff.

In another aspect, the pressed-in pattern comprises at least one of a straight horizontal ridge, a straight vertical ridge, a diagonal ridge, a vertical zig-zag ridge, or a nodule.

In another aspect, the invention provides a method for reducing drag on an athlete comprising the steps of: (i) providing an athletic garment comprising a panel substantially encircling an appendage of the athlete, the panel including at least two regions of surface texture of differing roughnesses; (ii) moving the appendage through a fluid to form a substantially laminar boundary layer flow around the athletic garment; and (iii) transitioning the boundary layer flow from laminar flow to turbulent flow at a critical velocity.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 29 is a schematic view of an appendage of an athlete partially covered by another embodiment of the inventive aerodynamic panel; and FIGS. 30-31 are schematic views of an aerodynamic panel similar to the embodiment shown in FIG. 29, showing various patterns for regions of different texture.

DETAILED DESCRIPTION OF THE PREFERRED EMBODIMENTS

Figure 1:
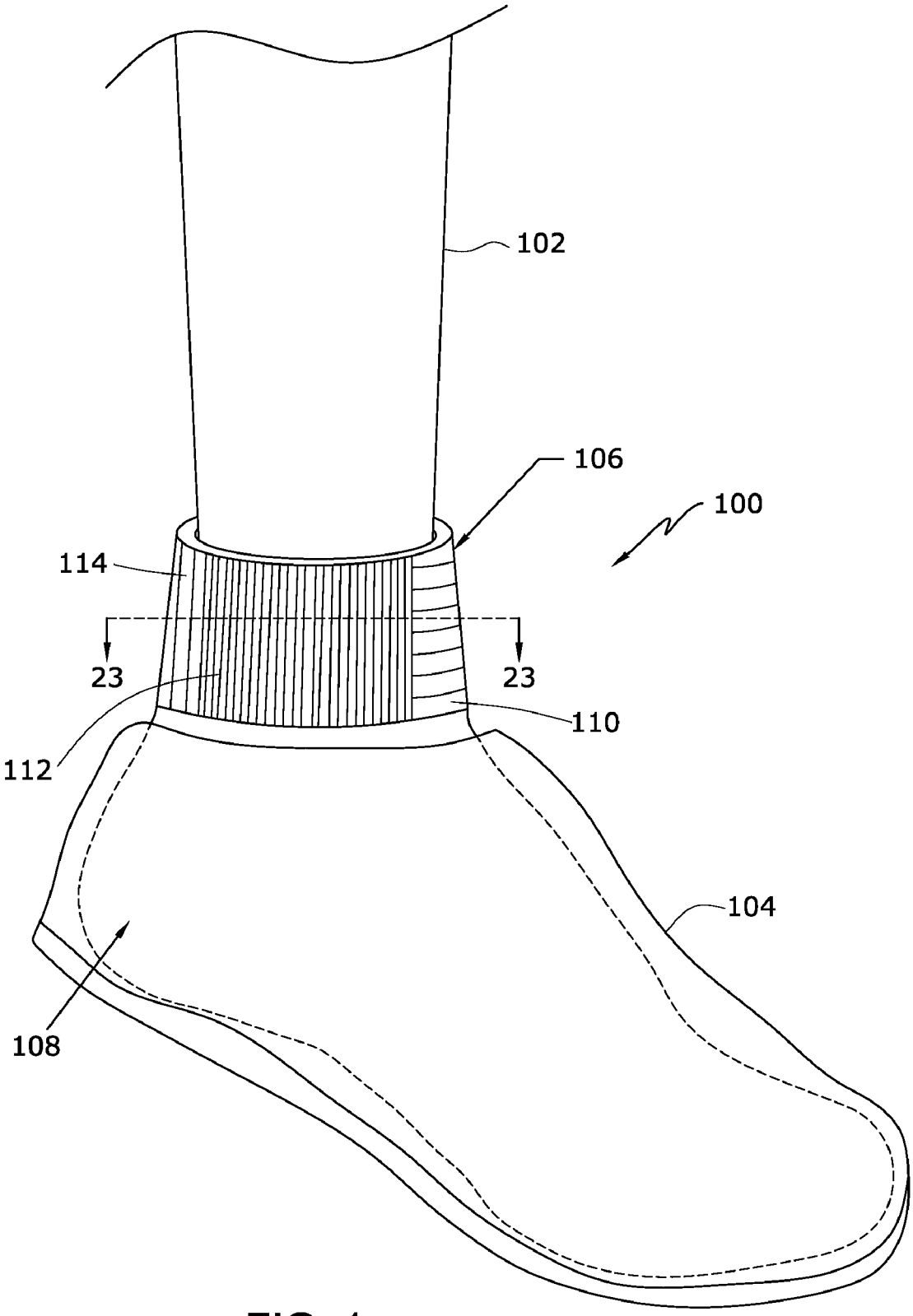
FIG. 1 is a schematic side view of a lower portion of an appendage of an athlete partially covered with an aerodynamic panel.

FIG. 1 is a schematic view of a portion of an appendage 102 of an athlete wearing an athletic garment 100 including a drag-reducing panel 106. In this embodiment, appendage 102 is a leg and athletic garment 100 is a sock. However, in other embodiments, appendage 102 may be any body part capable of being modeled as a substantially circular cylinder or sphere, for example, one or both legs, one or both arms, the head, the neck, and the like, and athletic garment 100 may be any type of garment that can encircle appendage 102, such as a wristband, headband, or sleeve. Optionally, a portion of appendage 102 and/or athletic garment 100 may be covered by an additional garment 104. In this embodiment, as appendage 102 is a leg, an optional shoe 104 is provided to cover the foot and a body portion 108 of athletic garment 100. Drag-reducing panel 106 is a cuff of the sock, configured to encircle the ankle region of appendage 102, forming an opening to provide access to body portion 108. Drag-reducing panel 106 may be attached to body portion 108 by any method known in the art, such as by sewing or by being integrally knitted with the body portion.

Athletic garment 100 is preferably made from a textile, such as a woven material, knitted natural material, for example wool or cotton, or knitted synthetic material, for example polyester, nylon, spandex, or spandex blend Appendage 102 protrudes out from and extends away from shoe 104. Drag-reducing panel 106 preferably covers only an exposed portion of appendage 102. In this embodiment, for example, drag-reducing panel 106 forms the cuff of sock 100. The height of drag-reducing panel 106 may vary widely depending upon factors such as the athletic event in which athletic garment 100 is intended to be worn, and the amount of fluid dynamic influence desired by the athlete. For example, a runner in a track-and-field event may wish for drag-reducing panel 106 to be relatively short, extending only a short distance above the top of shoe 104. A soccer player, however, may desire that drag-reducing panel 106 extend as far above shoe 104 to the mid-calf or even the knee.

Figure 2:
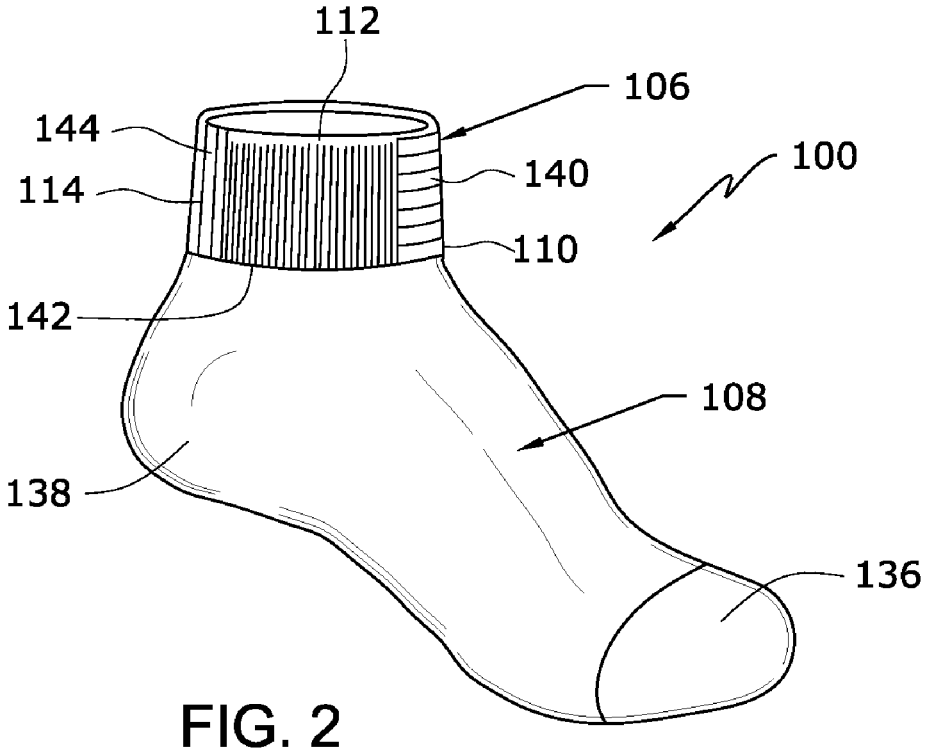
FIG. 2 is a medial side view of a sock including an aerodynamic panel.
Figure 3:
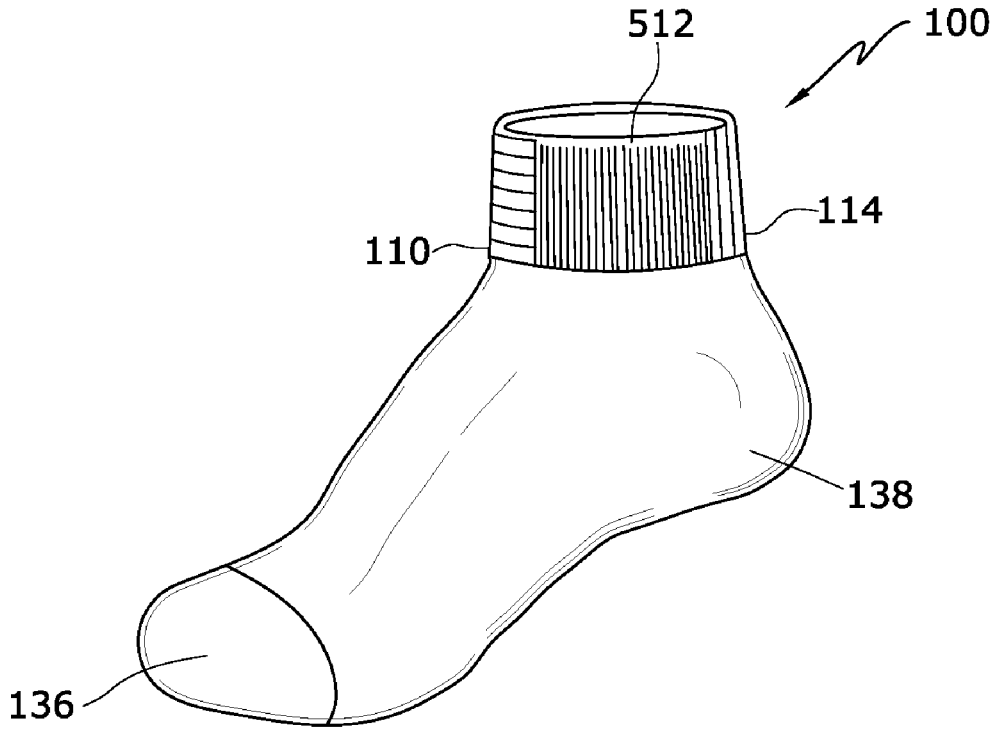
FIG. 3 is a lateral side view of a sock including an aerodynamic panel.

As shown in FIGS. 1-3, a portion of drag-reducing panel 106 includes at least two texturally distinct regions: a first region for smoothing laminar boundary layer flow and a second region for tripping the boundary layer to turbulent flow. In this embodiment, drag-reducing panel 106 includes three regions: a first region 110 positioned on and around the leading edge of appendage 102; a second region 112 positioned on one or both sides of appendage 102 adjacent to first region 110; and a third region 114 positioned on and around the trailing edge of appendage 102 and adjacent to second region 112. For the purposes of discussion, the leading edge of appendage 102 is the portion of appendage 102 directly facing the oncoming fluid flow. In this embodiment, the leading edge of appendage 102 is the front portion of the leg and/or ankle, generally positioned over a toe region 136 of sock body 108, while the trailing edge is generally positioned over a heel region 138 of sock body 108.

First region 110 is configured to channel the oncoming flow to second region 112 without causing a change in the boundary layer from laminar to turbulent flow. In this embodiment, first region 110 is provided with a pattern of horizontal ridges 140 at the surface of first region 110. Horizontal ridges 140 help to smooth the oncoming flow by presenting the oncoming flow with a profile that is generally parallel to the lamina of the flow. This texture helps to preserve the lamina of the flow and assists in reducing the drag component due to friction when the oncoming flow encounters appendage 102.

Horizontal ridges 140 preferably extend across the entirety of first region 110, but protrude only slightly from a baseline surface of drag-reducing panel 106. Further, to minimize the frictional impact of first region 110 on the oncoming flow, all horizontal ridges 140 on drag-reducing panel 106 preferably extend approximately the same height from a baseline on drag-reducing panel 106. In other embodiments, horizontal ridges 140 may extend only partially across first region, or first region 110 may be eliminated from the pattern of surface textures affecting fluidic performance.

Horizontal ridges 140 on first region 110 are preferably integrally woven with drag-reducing panel 106 by any method known in the art. However, in other embodiments, horizontal ridges 140 may be separately woven, pressed into a woven material using any method known for doing so, such as pressing a woven material between plates using heat and pressure, formed of a non-woven material, such as by compressing fibers together in a mold under heat and pressure, and stitched or adhered to an exterior surface of drag-reducing panel 106.

Second region 112, positioned adjacent to first region 110, is designed to cause the boundary layer to transition early or trip from laminar flow to turbulent flow, similar to how the dimples on a golf ball influence the aerodynamics of the golf ball. Second region 112 is provided with a rough texture to create the turbulent boundary layer. In this embodiment, second region 112 includes a series of vertical ridges 142. Vertical ridges 142 present to the oncoming flow a surface textured at right angles to the lamina of the flow. As such, flowing over vertical ridges 142 causes the lamina of the boundary layer to separate, thereby causing turbulent flow, sooner than if the fluid were flowing over a smoother surface. As such, the fluid is able to adhere to and flow along the surface of drag-reducing panel longer than if the boundary layer remained laminar.

Vertical ridges 142 are sized and dimensioned to trip the flow, but preferably do not present an extremely rough surface texture, as such a texture could not only trip the flow but also separate the flow from the surface of drag-reducing panel 106. Therefore, vertical ridges 142 are preferably relatively narrow and extend over the entire height of drag-reducing panel 106. Further, a large number of closely-packed vertical ridges 142 are provided.

Second region 112 is adjacent to first region 110, and may be attached to first region 110 by any method known in the art. Preferably, second region 112 is integrally woven with first region 110, such as by knitting. The surface texture of second region 112 is also preferably integrally woven with the remainder of second region 112, although, as with first region 110, the surface texture may be separately woven or formed from non-woven materials and to affixed to second region 112, such as by stitching or with an adhesive. In such a case, the surface texture of second region 112 is preferably permanently affixed to second region 112.

As shown in FIG. 3, second region 112 is preferably mirrored on the opposite side of drag-reducing panel 106 by an optional region 512, which is preferably identical to second region 112. However, in other embodiments, optional region 512 may be smooth, or an extension of first region 110. If only one of second region 112 or optional region 512 is used for sock 108, preferably second region 112 is positioned on a lateral side of sock 108.

A third region 114, positioned adjacent to second region 112, is designed to create even more turbulent flow than second region 112 to hold the flow against the surface of drag-reducing panel 106. Although similar to second region 112, third region 114 is preferably provided with an even rougher surface texture than second region 112. In this embodiment, third region 114 includes a series of wide vertical ridges 144, where the width and depth of wide vertical ridges 144 is larger than the width of vertical ridges 142 in second region 112. Like vertical ridges 142, wide vertical ridges 144 present to the oncoming flow a surface textured at right angles to the lamina of the flow. Due to the greater width and depth of wide vertical ridges 144, however, the flow passing over wide vertical ridges 144 is impacted to a greater degree than the flow passing over vertical ridges 142. As such, flowing over wide vertical ridges 144 causes even greater turbulence in the flow than the flow passing over second region 112. As such, the fluid is able to adhere to and flow along the surface of drag-reducing panel 106 longer.

The size and number of both horizontal ridges 140 and vertical ridges 142 may vary in different embodiments depending upon many factors, such as the height of aerodynamic panel 106, preferred manufacturing technique, the anticipated circumference of appendage 102, etc. For the purposes of example only, in one embodiment, a sock is provided with an aerodynamic panel having a height of 51 mm above the lateral malleolus. The sock includes seven 6 mm horizontal ridges separated by a distance of 1 mm. In another embodiment, a sock is provided with an aerodynamic panel having a height of 156 mm above the lateral malleolus. In this embodiment, the aerodynamic panel includes 24, 6 mm horizontal ridges separated by a distance of 1 mm.

Figure 4:
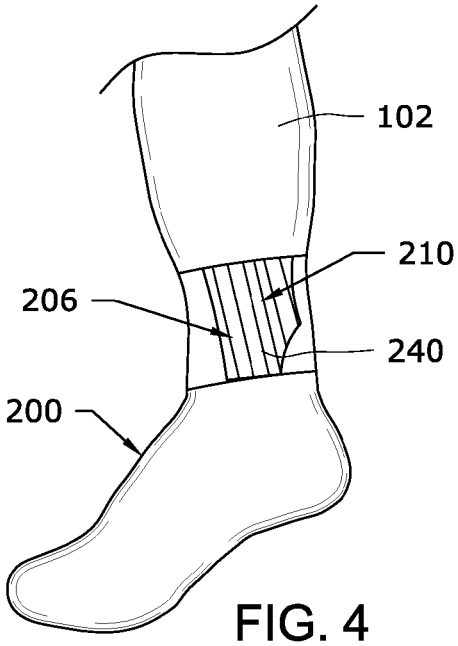
FIGS. 4-8 are schematic side views of a lower portion of an appendage wearing a sock including alternate embodiments of the inventive aerodynamic panel, showing various textures.

The textures of the inventive aerodynamic panel are not limited to ridges. In other embodiments, as shown in FIGS. 4-8, alternate textures are formed. FIG. 4 shows a sock 200 on appendage 102 including an aerodynamic panel 206. Vertical bands 240 are formed in only one region 210, preferably located on at least one of the lateral and medial sides of aerodynamic panel 206. Preferably, vertical bands 240 are similar to vertical ridges 144, with vertical bands 240 being wider than vertical ridges 144. The rest of sock 200 has a generally smooth texture.

Figure 5:
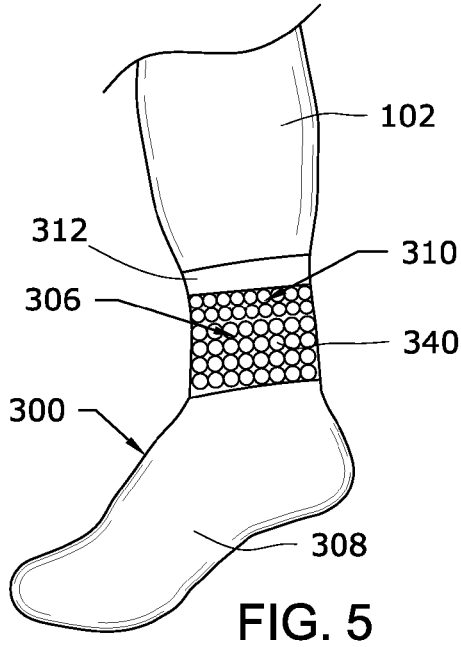

FIG. 5 shows a sock 300 on appendage 102 including an aerodynamic panel 306. Aerodynamic panel 306 includes one large textural region 310 and an upper cuff 312 encircling appendage 102. In this embodiment, the texture on region 310 includes a series of tightly-packed oval nodules 340. Oval nodules 340 have a hump-like, convex structure extending away from appendage 102. Oval nodules 340 may be uniform or may vary in size. The sock base 308 and cuff 312 have a substantially smooth texture.

Figure 6:
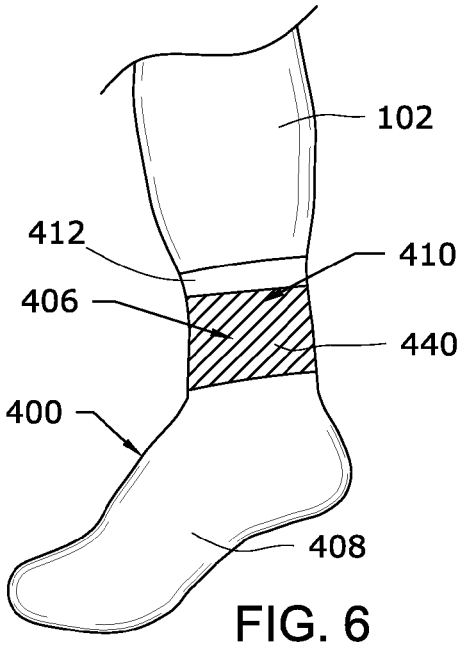

FIG. 6 shows a sock 400 on appendage 102 including an aerodynamic panel 406. Aerodynamic panel 406 includes a large textural region 410 and an upper cuff 412 encircling appendage 102. In this embodiment, the texture of region 410 includes a series of diagonal ribs 440. Diagonal ribs 440 are similar to horizontal ridges 140 or vertical ridges 142, discussed above, in that diagonal ribs are generally linear protrusions extending away from appendage 102. Diagonal ribs 440 may slant in any direction, although preferably the directionality of the slant of diagonal ribs 440 channels the flow of air toward a rear or trailing edge of appendage 102. In this embodiment, upper cuff 412 and a sock body 408 preferably have a smooth texture.

Figure 7:
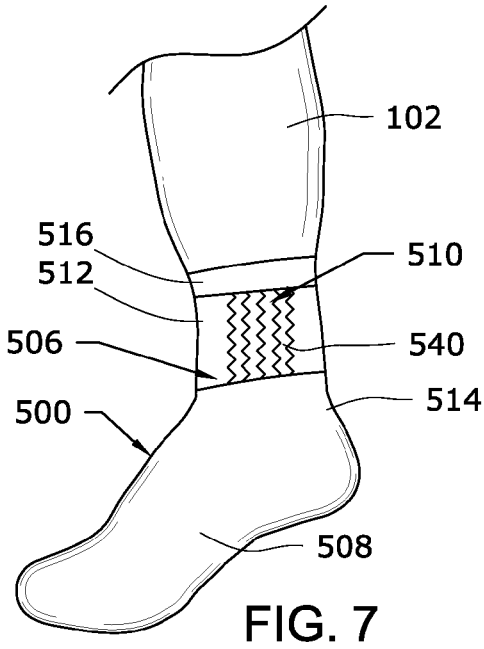
Figure 8:
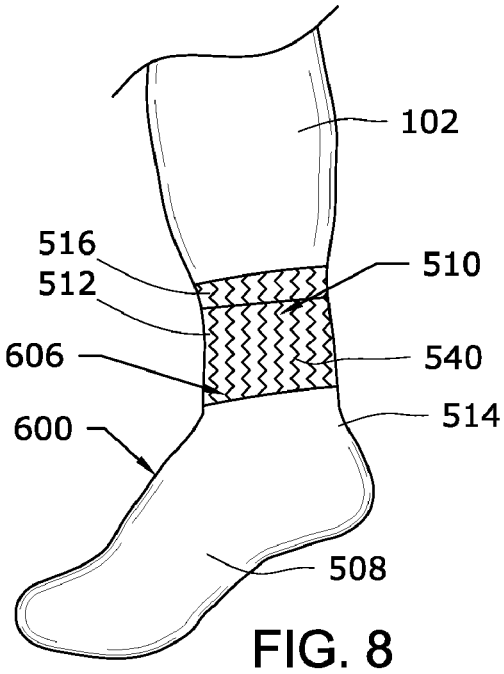
Figure 9:
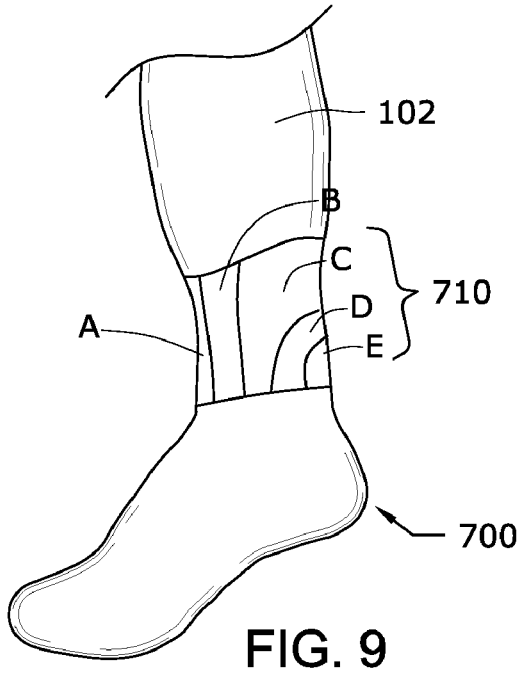
FIGS. 9-16 are schematic side views of a lower portion of an appendage wearing a sock including alternate embodiments of the inventive aerodynamic panel, terminating at a lower height above the ankle and showing various patterns for regions of different texture.

FIG. 7 shows a sock 500 on appendage 102 including an aerodynamic panel 506. Aerodynamic panel 506 includes a large textural region 510 along the sides of appendage 102 with a forward region 512 and a trailing edge region 514 positioned adjacent to textural region 510. An upper cuff 516 encircles appendage 102. In this embodiment, the texture of region 510 includes a series of vertical zig-zag ribs 540. Ribs 540 preferably follow a straight path from upper cuff 516 to a sock body 508. Forward region 512, trailing edge region 514, upper cuff 516, and sock body 508 preferably have a smooth texture. A sock 600, shown in FIG. 8, is similar to sock 500, with zig-zag ribs 540 covering forward region 512, trailing edge region 514, and upper cuff 516 in addition to textural region 510. Sock body 508 preferably remains smooth.

Additionally, the number and relative positioning of regions of different texture on the inventive athletic garment may be varied. FIGS. 9-22 show alternate embodiments for the number and positioning of regions of different texture on an aerodynamic panel of an athletic garment positioned on appendage 102. FIGS. 9 and 11-16 show athletic garments as quarter-length socks 700, 900, 1000, 1100, 1200, 1300, 1400, with respective aerodynamic panels 706, 906, 1006, 1106, 1206, 1306, 1406. Preferably, a quarter-length sock has a maximum height of about 51 mm above the lateral malleolus. FIGS. 10 and 17-22 show the inventive athletic garments as crew-length socks 800, 1500, 1600, 1700, 1800, 1900, 2000, with respective aerodynamic panels 810, 1506, 1606, 1706, 1806, 1906, 2006. Preferably, a crew-length sock has a maximum height of 156 mm above the lateral malleolus. While only these two heights of socks are shown, other heights above the lateral malleolus may be employed in other embodiments.

Figure 10:
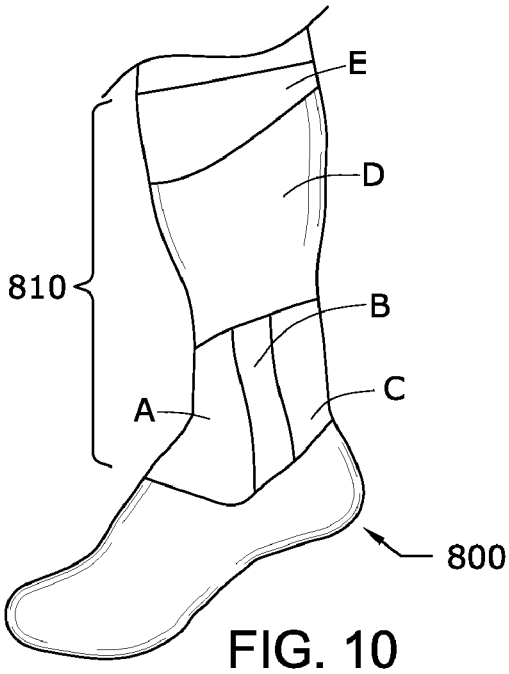
Figure 11:
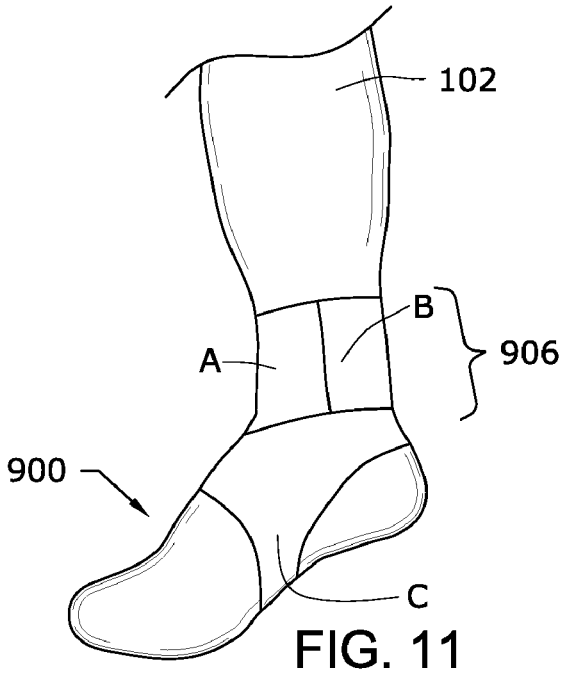
Figure 12:
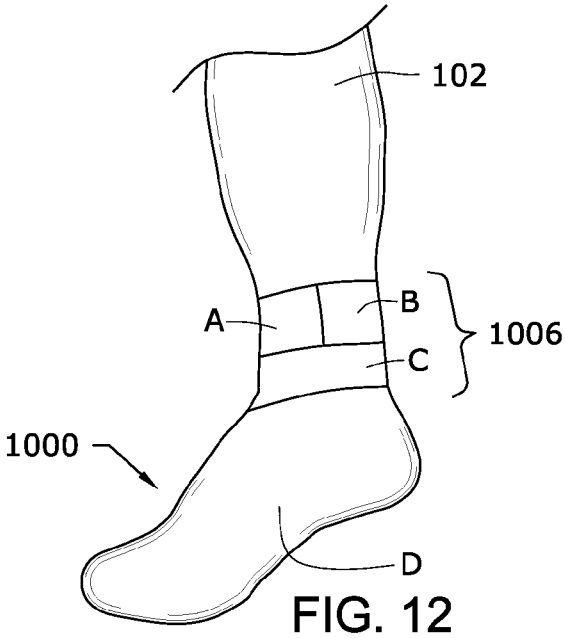
Figure 13:
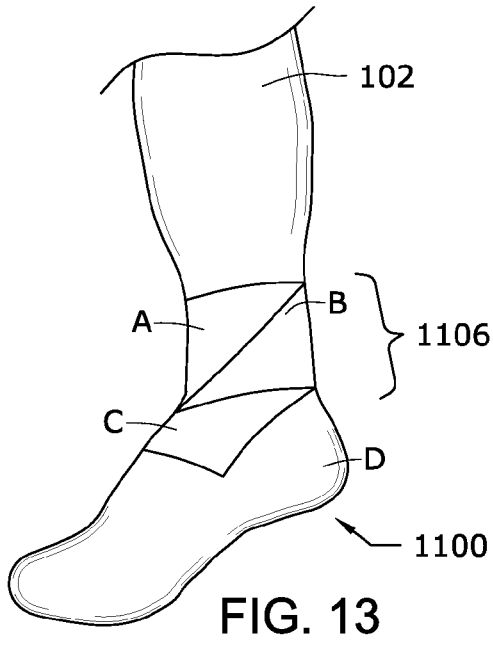
Figure 14:
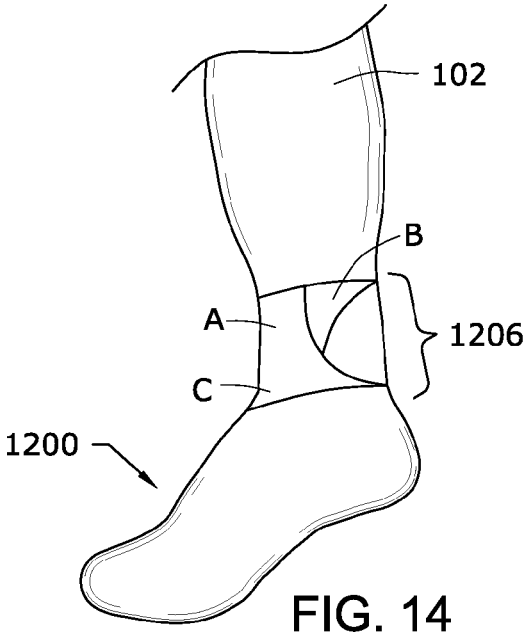
Figure 15:
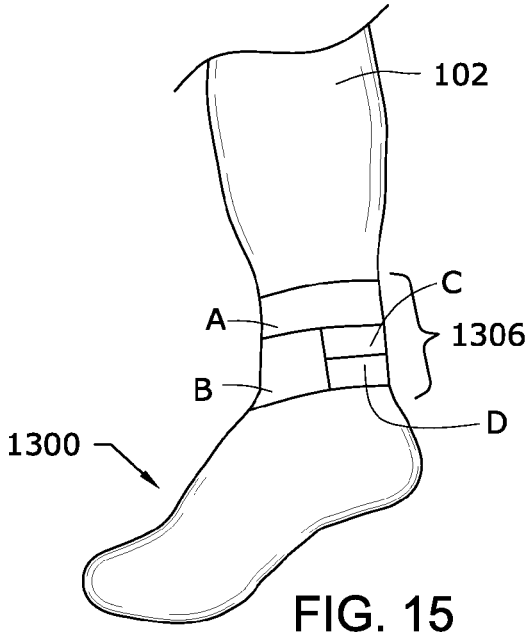
Figure 16:
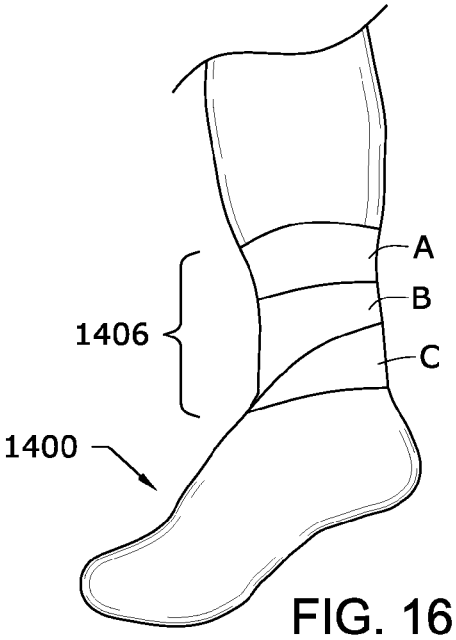
Figure 17:
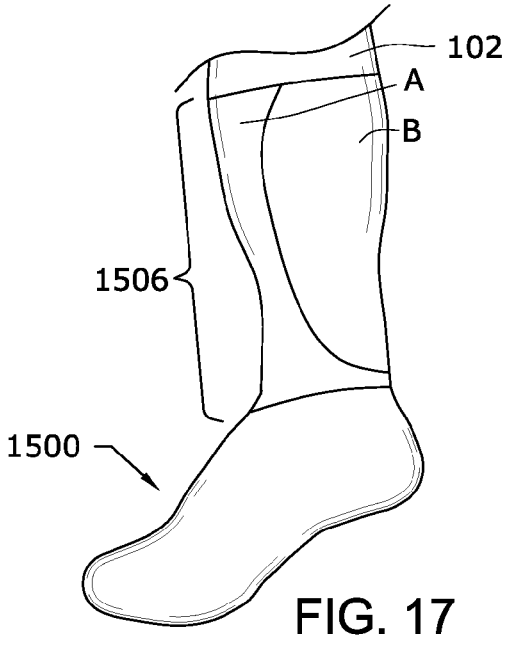
FIGS. 17-22 are schematic side views of a lower portion of an appendage wearing a sock including alternate embodiments of the inventive aerodynamic panel, terminating at a greater height above the ankle and showing various patterns for regions of different texture.
Figure 18:
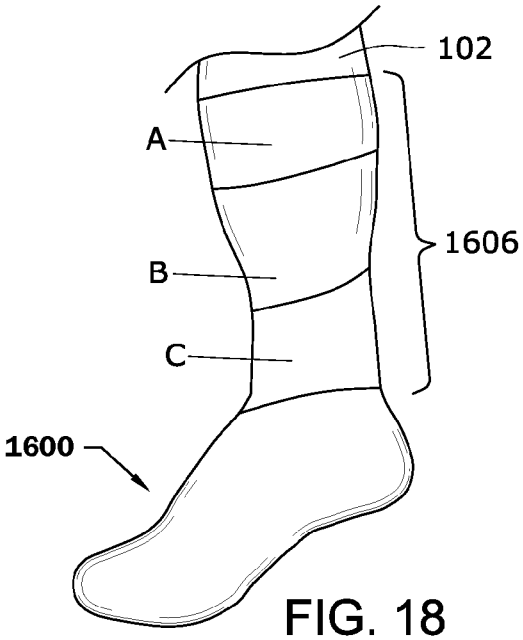
Figure 19:
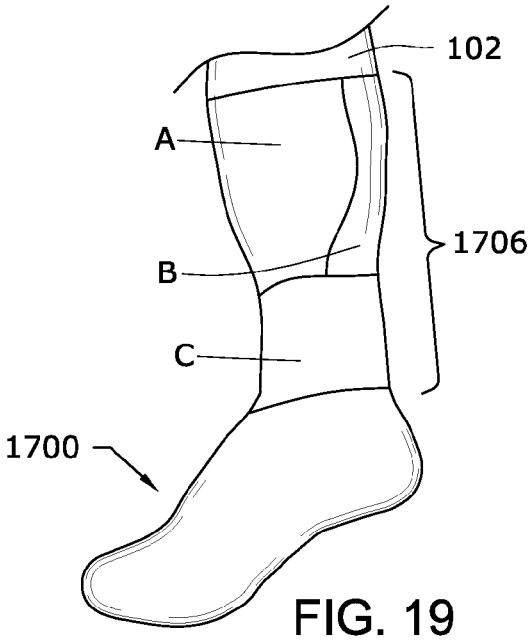
Figure 20:
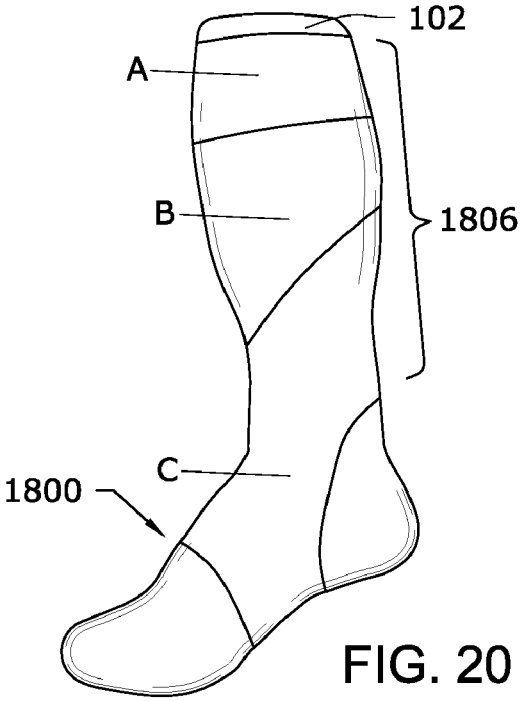
Figure 21:
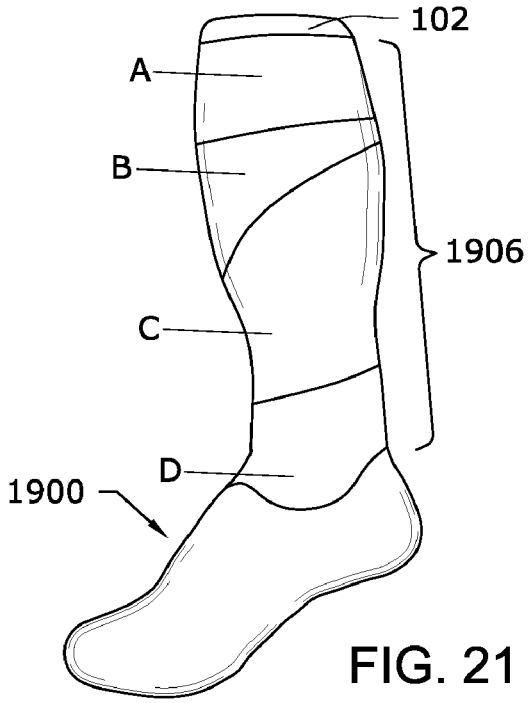
Figure 22:
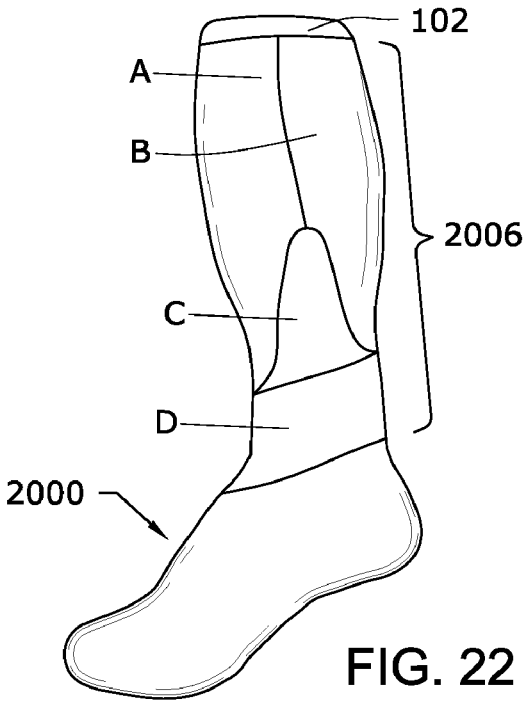

Each aerodynamic panel 706, 810, 906, 1006, 1106, 1206, 1306, 1406, 1506, 1606, 1706, 1806, 1906, 2006 includes three (3) to five (5) regions of different texture A, B, C, D, E. Each region A-E may have any of the textures discussed above or may have a smooth texture. The selection of patterns of texture depends upon many factors, including the type of athletic event for which the inventive athletic garment is to be used. For example, a configuration such as that shown in FIGS. 11 and 20, where a portion of textured region C extends over the foot, would be selected for an activity in which the foot remains exposed or where athletic garment may be worn over footwear, such as in gymnastics or skating events. Other configurations may be selected depending upon the type of motion expected during the athletic event. For example, if an athlete is always running in a forward motion, a simple configuration such as is shown in FIG. 17 may be appropriate. However, if more complicated motions are anticipated, such as in playing soccer or other sport where forward, backward, and sideways cutting motions are anticipated, a more complex configuration, such as is shown in FIG. 10 may be preferred.

It will be appreciated that the present invention utilizes the surface texture properties of athletic garment 100 to reduce total drag and induce flow transition at appropriate velocities on appendage 102. The surface roughness properties of athletic garment 100 are preferably scaled to the diameter and velocity of appendage 102 in order to induce flow transition at or near the maximum velocity of appendage 102. In other words, the surface roughness of athletic garment 100 as used on an arm preferably differs from the surface roughness of athletic garment 100 as used on a leg.

Figure 23:
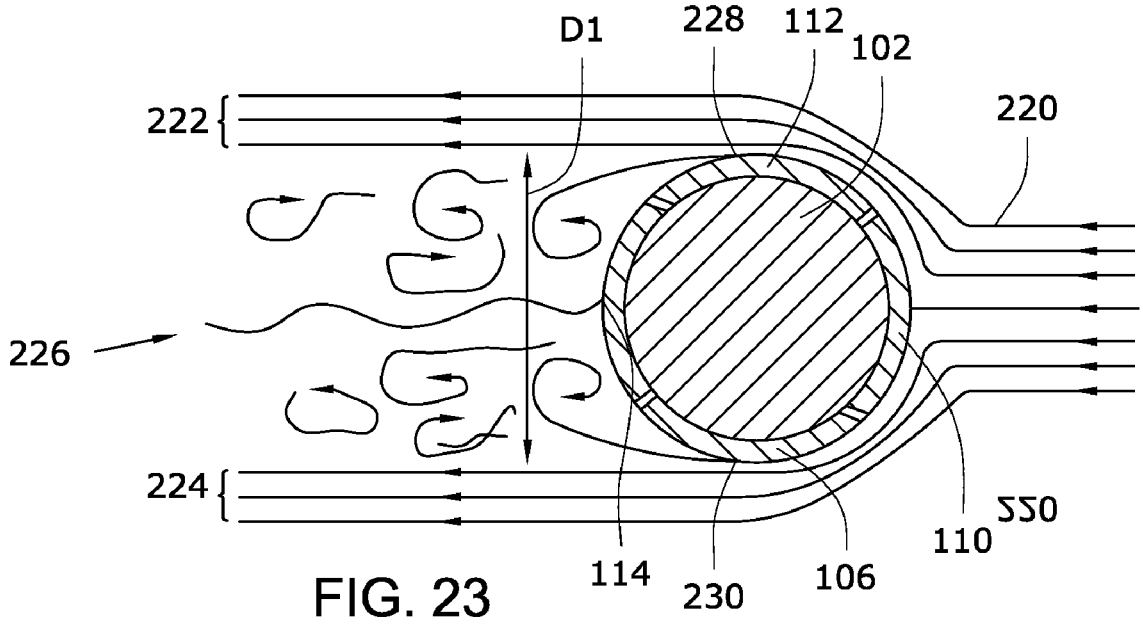
FIG. 23 is a schematic cross-sectional view of the lower portion of the appendage of FIG. 1 taken along line 23-23, showing the flow pattern of the air around the aerodynamic panel at low speeds.
Figure 24:
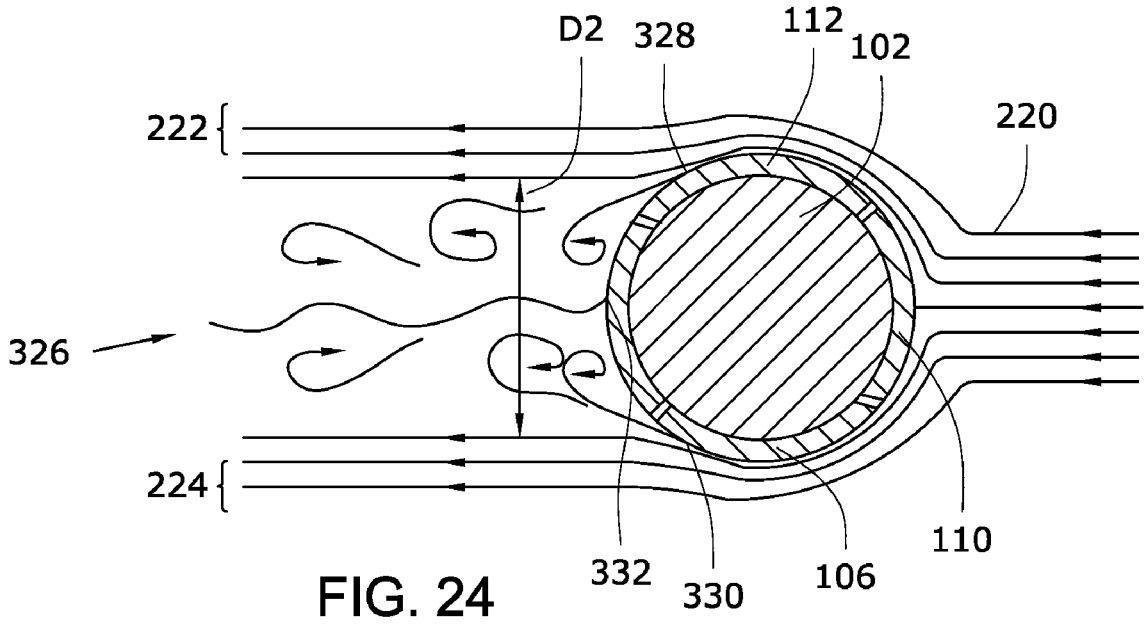
FIG. 24 is a schematic cross-sectional view of the lower portion of the appendage of FIG. 1 taken along line 23-23, showing the flow pattern of the air around the aerodynamic panel at high speeds.

Referring to FIGS. 23 and 24, the operation of the inventive athletic garment in reducing drag is explained. FIGS. 23 and 24 discuss with particularity the embodiment of athletic garment 100 as shown in FIGS. 1-3. However, the discussion applies generally to all embodiments shown and discussed in this application with respect to changing the nature of the boundary layer of the fluid flowing around the aerodynamic panels of the athletic garments. In the following discussion, the athlete is not limited to a single type of athletic endeavor, as athletic garment 100 may be used in a variety of sports, exercises, and/or physical activities.

As an athlete performs any type of sport, exercise, or physical activity, appendage 102 is forced through a fluid 220 having density and an initial pressure. For example, as a cyclist operates the bicycle, the leg of the cyclist is pushed through the air. Appendage 102 experiences fluid 220 as though appendage 102 is held still while fluid 220 flows around appendage 220, as shown by the flow lines in FIGS. 23 and 24. As fluid 220 encounters appendage 102, modeled here as a circular cylinder, fluid 220 is split into two flow paths around appendage 102: first flow 222 and second flow 224. Both first and second flows 222, 224 initially follow closely the outer surface of appendage 102. First and second flows 222, 224 are assisted in this adhesion initially by first region 110. First region 110 is configured to smooth the laminar boundary layer flow of first and second flows 222, 224 by channeling the flow. As such, first and second flows 222, 224 pass from first region 110 to second region 112 remaining close to the surface of appendage 102.

At relatively slow velocities, as shown in FIG. 23, once first and second flows 222, 224 have flowed over approximately the first hemisphere of appendage 102, first and second flows 222, 224 are no longer capable of retaining laminar boundary layer characteristics and can no longer adhere to the shape of appendage 102. First flow 222 breaks away from appendage 102 at first separation point 228, which is positioned at or near the hemispherical point of appendage 102. Similarly, second flow 224 breaks away from appendage 102 at a second separation point 230, which is positioned opposite to first separation point 230. First flow 222 and second flow 224 now define the outer perimeter of wake 226, a region of turbulent, unstable flow in which the fluid pressure in the wake is lower than the initial pressure of fluid 220. The area of wake 226 is determined by the distance D1 between first flow 222 and second flow 224. Typically, distance D1 is approximately the same as or slightly less than the diameter of appendage 102. The force due to drag FD on appendage 102 is generally determined by multiplying wake pressure by wake area.

Once the athlete achieves a threshold velocity, however, second region 112 is capable of tripping the boundary layer of fluid 220 from laminar flow to turbulent flow. As shown in FIG. 24, the turbulent boundary layer of fluid 220 causes first flow 222 to separate from the surface of drag-reducing panel 106 at a first shifted separation point 328. First shifted separation point 328 is pushed toward a trailing edge 332 of appendage 102. Similarly, second flow 224 separates from the surface of drag-reducing panel 106 at a second shifted separation point 330. Second shifted separation point 328 is also pushed toward trailing edge 332. As such, both first and second flows 222, 224 are able to flow along the surface of drag-reducing panel 106 to a greater extent than at slower velocities or without including drag-reducing panel 106 on the athletic garment.

The shifting of separation points 328, 330 toward trailing edge 332 results in a narrower wake 326. New wake 326 has a reduced diameter D2, where D2 is less than diameter D1. The fluid pressure within new wake 326 is generally the same as that of the pressure within wake 226. As such, the reduction in diameter of new wake 326 over wake 226 has a corresponding reduction in the drag force, as the same pressure is acting over a smaller area. Therefore, by tripping the flow of fluid 220 using the surface texturing of drag-reducing panel 106, the drag force is reduced.

The amount of reduction in drag force due to drag-reducing panel 106 is influenced by many design and operational factors, including the height of drag-reducing panel 106, such as the amount of exposed cuff of a sock; the amount of texture provided in the textured regions 110, 112, 114; the material used to make athletic garment 100; the velocity of the athlete; the density of the fluid, for example competing at a high altitude as opposed to competing at sea level; the inclusion of additional items of apparel in the vicinity of drag-reducing panel 106, such as the type of shoe worn when drag-reducing panel 106 is included as the cuff of a sock; and the like.

Example: an artificial leg provided with a variety of different socks was tested in a wind tunnel at airflow velocities ranging from about 5 m/s to about 35 m/s. A first test sock TS1 was made substantially in accordance with the embodiment above and shown in FIGS. 1-3, with a body attached to a cuff configured to substantially encircle the ankle of the wearer. First test sock TS1 has a cuff which extends about 110 mm above the lateral malleolus. A second test sock TS2 is a generic rugby sock, with a uniform, relatively loose knit structure. Second test sock TS2 extends about 320 mm above the lateral malleolus. A third test sock TS3 is a soccer sock from a first major manufacturer, having a uniform tightly knit structure. Third test sock TS3 extends about 320 mm above the lateral malleolus. A fourth test sock TS4 is a soccer sock from a second major manufacturer, having a uniform tightly knit structure. Fourth test sock TS4 extends about 320 mm above the lateral malleolus. A final test was performed on a bare leg BL. All tests were performed on the artificial leg wearing a Nike 3-strap cycling shoe.

Figure 25:
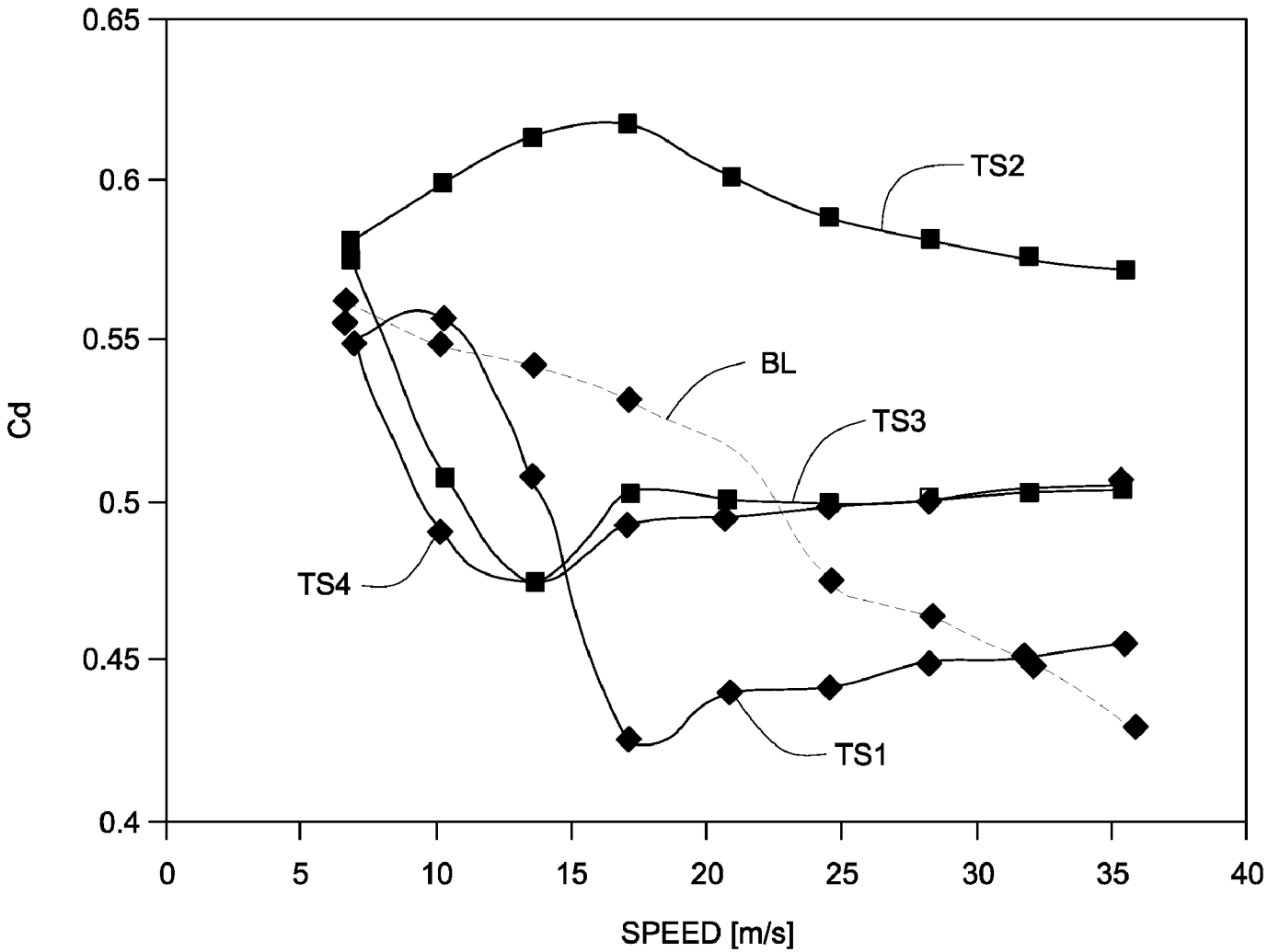
FIG. 25 is a graph showing the Coefficient of Drag versus Speed of various socks covering a leg model in a wind tunnel.

A comparative drag coefficient Cd, which is the drag divided by the dynamic pressure, was determined at each speed. FIG. 25 is a graph reflecting the results of the test, plotting the comparative drag coefficient Cd (dimensionless) versus speed (m/s). At lower speeds, first test sock TS1 provides about the same drag as the other socks and bare leg. However, at a critical speed, approximately 10 m/s, the drag on first test sock TS1 starts to drop off dramatically, and from about 15 m/s to about 30 m/s, the least drag is produced by first test sock TS1. At about 30 m/s, the bare leg BL, which produced almost linearly decreasing drag as speed increased, begins to produce less drag than first test sock TS1. Third test sock TS3 and fourth test sock TS4, with uniform, relatively smooth structures, provide about the same drag at all speeds, with initial decreases. Second test sock TS2, with the roughest uniform texture, provides the most drag at every speed.

The inventive athletic garment is not limited to a sock; rather, the inventive athletic garment may assume any configuration that substantially encircles an appendage of an athlete, including but not limited to legs, arms, hands, neck, and the head. The inventive athletic garment generally reduces drag on the appendage by transitioning the flow from laminar to turbulent at an earlier point to decrease the area of the wake, as describe above in FIGS. 23 and 24. Additional embodiments of the inventive athletic garment which perform this function are described below.

Figure 26:
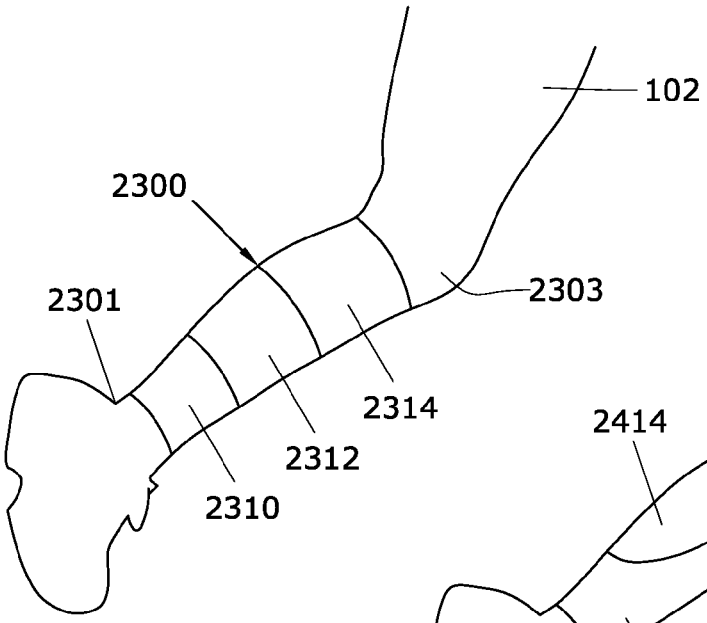
FIG. 26 is a schematic side view of an appendage of an athlete partially covered by another embodiment of the inventive aerodynamic panel.

FIG. 26 shows an embodiment of an athletic garment 2300 similar in material and construction as athletic garment 100 shown and discussed above, but configured to encircle at least a portion of a leg 102 but not a foot, similar to a dancer's leg warmer. Such an embodiment may be desirable in an event where the footwear for the event does not readily accommodate a sock, where an athlete prefers a particular type of sock for another purpose such as comfort or wicking properties but wishes to use an aerodynamic panel, or where an athlete desires the additional coverage of a garment extending over a greater portion of the leg such as in colder weather events. For example, athletic garment 2300 may be used in activities such as distance running, skating, etc. In this embodiment, the entirety of athletic garment 2300 may be the aerodynamic panel, with a first texture region 2310 positioned closest to an ankle region 2301, a second texture region 2312 positioned adjacent to first texture region 2310. A third texture region 2314 is positioned closest to a knee region 2303 and adjacent to second texture region 2312. The textures used in first texture region 2310, second texture region 2312, and third texture region 2314 are preferably any of those shown and discussed above in FIGS. 2-8. In other embodiments, other textures or no texture is provided in regions 2310, 2312, 2314.

Figure 27:
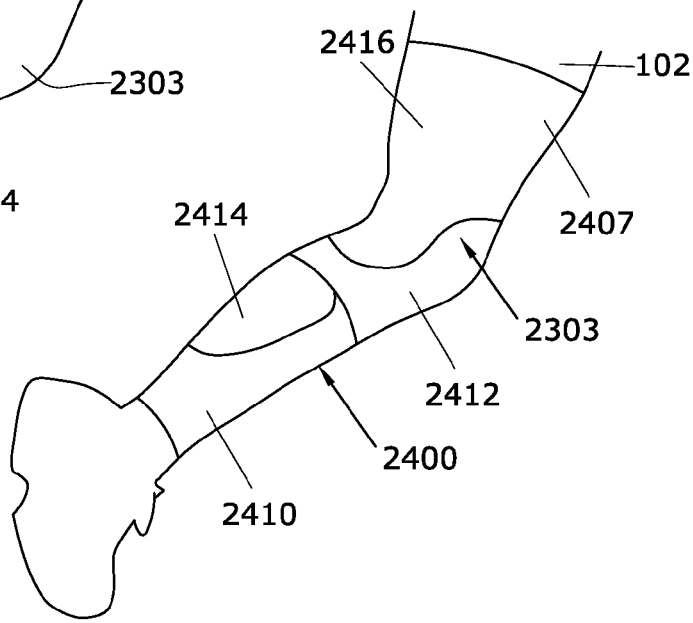
FIGS. 27-28 are schematic side view of an aerodynamic panel similar to the embodiment shown in FIG. 26, showing various patterns for regions of different texture.

FIG. 27 shows an athletic garment 2400 similar to athletic garment 2300, but with more regions of texture: a first region 2410, a second region 2412, a third region 2414, and a fourth region 2416. Preferably, athletic garment 2400 covers more of appendage 102 than athletic garment 2300, for example, when an athlete requires a brace or support over the knee joint but wishes to maintain aerodynamic flow over appendage 102. In this embodiment, second region 2412 covers a knee portion 2407 of appendage 102, and fourth region 2416 preferably encircles a thigh portion of appendage 102. The textures used in first texture region 2410, second texture region 2412, third texture region 2414, and fourth texture region 2416 are preferably any of those shown and discussed above in FIGS. 2-8. In other embodiments, other textures or no texture is provided in regions 2410, 2412, 2414, 2416.

Figure 28:
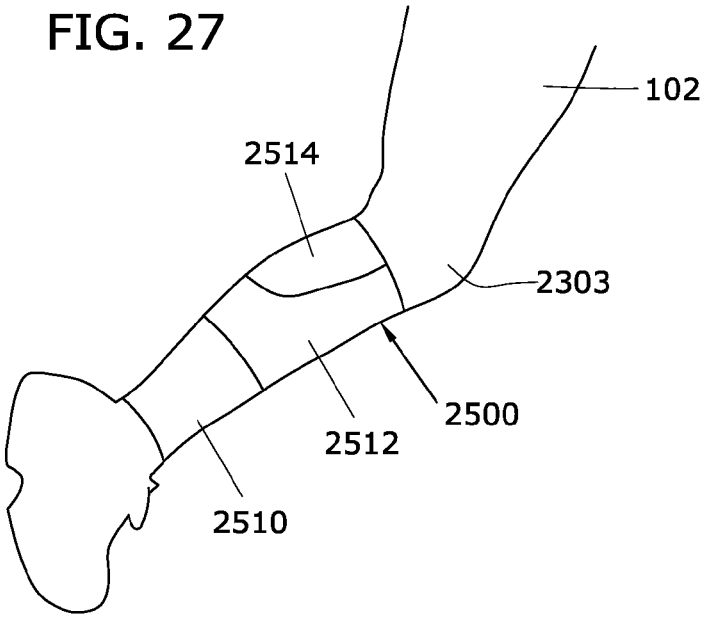

FIG. 28 shows an athletic garment 2500 similar to athletic garment 2300, but with a different placement for the regions of texture: a first region 2510 encircles a lower portion of appendage 102, a second region 2512 is adjacent to first region 2510 and substantially covers a front portion of appendage 102 below a knee region 2303. A third region 2514 is adjacent to second region 2512 and substantially covers a rear portion of appendage 102 below knee region 2303. The textures used in first texture region 2510, second texture region 2512, and third texture region 2514 are preferably any of those shown and discussed above in FIGS. 2-8. In other embodiments, other textures or no texture is provided in regions 2510, 2512, 2514. This configuration for athletic garment 2500 may be used by an athlete whose sport or activity requires more complex leg motions than running straight ahead, such as in soccer, lacrosse, or the like where an athlete may run forward, backwards, or cut in a sideways direction.

The inventive athletic garment is not limited to use on a leg. As discussed above, the inventive athletic garment may be used on any appendage. As shown in FIGS. 29-31, the inventive athletic garment may be used as a sleeve for an arm 2602. FIG. 29 shows an athletic garment 2600 which may be used in athletic events such as tennis, baseball, softball, or the like where the arm is used to swing repeatedly. In this embodiment, the entirety of athletic garment 2600 forms an aerodynamic panel extending from a wrist region 2605 to an elbow region 2603 to optimize the air flow past arm 2602. This optimization, as described above with respect to FIGS. 23 and 24, may yield a faster swing and/or reduced fatigue over the duration of play. Athletic garment 2600 includes three regions of texture: a first region 2610, a second region 2612, and a third region 2614. First region 2610 preferably substantially covers wrist region 2605 but does not extend over a hand 2604. Second region 2612 is preferably adjacent to first region 2610 and extends to elbow region 2603 to cover a portion of arm 2602. Third region 2614 is preferably adjacent to both first region 2610 and second region 2612 and also extends to elbow region 2603. This arrangement allows for the boundary layer of the fluid flowing around arm 2602 to trip to turbulent flow regardless of the direction of motion of arm 2602. For example, if a tennis player swings forehand or backhand, optimal aerodynamics may be achieved.

The textures used in first texture region 2610, second texture region 2612, and third texture region 2614 are preferably any of those shown and discussed above in FIGS. 2-8. In other embodiments, other textures or no texture is provided in regions 2610, 2612, 2614. Athletic garment 2600 is made from similar materials and in a similar manner as the other athletic garments discussed above, such as athletic garment 100. Preferably, athletic garment 2600 is a sleeve configured to slide onto arm 2602 over hand 2604 so that no fasteners are employed. However, in other embodiments, fasteners (not shown) may be used to secure athletic garment 2600 to arm 2602, such as snaps, a zipper, or the like. Preferably, these fasteners are low-profile or carry a profile capable of being incorporated into the texture patterns of the appropriate region.

FIG. 30 shows another sleeve-type athletic garment 2700, similar to athletic garment 2600 discussed above. In this embodiment, athletic garment 2700 extends from hand 2604 of appendage 2602 to a bicep region 2607. Preferably, the entirety of athletic garment 2700 is the aerodynamic panel. Athletic garment 2700 includes four regions of texture. A first region 2710 preferably covers a portion of hand 2604 and ends at wrist region 2605. First region 2710 is preferably formed as a fingerless glove. A second region 2712 is preferably positioned between and adjacent to first region 2710 and a third region 2714, with third region 2714 terminating at or near an elbow region 2603. A fourth region 2716 is adjacent to third region 2603 and terminates in bicep region 2607.

The textures used in first texture region 2710, second texture region 2712, third texture region 2714, and fourth texture region 2716 are preferably any of those shown and discussed above in FIGS. 2-8. In other embodiments, other textures or no texture is provided in regions 2710, 2712, 2714, 2716. Athletic garment 2700 is made from similar materials and in a similar manner as the other athletic garments discussed above, such as athletic garment 100. Preferably, similar to athletic garment 2600, athletic garment 2700 is a sleeve configured to slide onto arm 2602 over hand 2604 so that no fasteners are employed, although fasteners may be used in other embodiments.

FIG. 31 shows another sleeve-type athletic garment 2800, similar to athletic garments 2600 and 2700 discussed above. In this embodiment, athletic garment 2800 extends from wrist region 2605 of appendage 2602 to bicep region 2607. Preferably, the entirety of athletic garment 2800 is the aerodynamic panel. Athletic garment 2800 includes four regions of texture. A first region 2810 preferably covers wrist region 2605 and extends to elbow region 2603. A second region 2812 is preferably positioned adjacent to first region 2810 and also extends to elbow region 2603. A third region 2814 and a fourth region 2816 each extend from elbow region 2603 to bicep region 2607, with each region preferably occupying approximately half of bicep region 2607. Third region 2814 is preferably adjacent to both first region 2810 and second region 2812, while fourth region 2816 is preferably adjacent only to second region 2812.

The textures used in first texture region 2810, second texture region 2812, third texture region 2814, and fourth texture region 2816 are preferably any of those shown and discussed above in FIGS. 2-8. In other embodiments, other textures or no texture is provided in regions 2810, 2812, 2814, 2816. Athletic garment 2800 is made from similar materials and in a similar manner as the other athletic garments discussed above, such as athletic garment 100. Preferably, similar to athletic garment 2600, athletic garment 2800 is a sleeve configured to slide onto arm 2602 over hand 2604 so that no fasteners are employed, although fasteners may be used in other embodiments.

FIGS. 30 and 31 show embodiments which may be used, for example, in cases where more of the arm is desired to have aerodynamic features, such as if a brace or other support is required for the wrist or elbow. In such cases, athletic garments 2700, 2800 may be provided to minimize the aerodynamic effect of wearing a brace, which may produce undesirable aerodynamics.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A garment comprising:

a panel substantially encircling an appendage of a wearer, wherein the panel is configured to reduce drag on the appendage of the wearer from an oncoming fluid;

the panel further comprising:

a first panel region having a first texture, a second panel region having a second texture, and a third panel region having a third texture;

wherein the first texture is configured to channel a flow pattern of the oncoming fluid without disrupting a laminar flow;

wherein the second texture includes one or more ridges configured to transition the flow pattern of the oncoming fluid from laminar flow to a turbulent flow;

wherein the third texture includes one or more ridges configured to increase the turbulent flow of the oncoming fluid; and wherein the ridges associated with the third texture are wider than the ridges associated with the second texture.

2. The garment according to claim 1, wherein the second texture is positioned adjacent to the first texture; and wherein the third texture is positioned adjacent to the second texture.

3. The garment according to claim 2, wherein the first texture, the second texture, and the third texture are woven into the panel.

4. The garment according to claim 1, wherein the first texture comprises at least one of a straight horizontal ridge, a diagonal ridge, a vertical zig-zag ridge, or a nodule.

5. The garment according to claim 1, wherein the one or more ridges associated with the second texture comprise at least one of a straight vertical ridge, a diagonal ridge, a vertical zig-zag ridge, or a nodule.

6. The garment according to claim 1, wherein the first texture is positioned at a leading edge of the appendage.

7. The garment according to claim 1, wherein the first texture comprises parallel ridges positioned substantially parallel to a flow pattern of the oncoming fluid.

8. The garment according to claim 1, wherein the one or more ridges associated with the third texture comprise at least one of a straight vertical ridge, a diagonal ridge, a vertical zig-zag ridge, or a nodule; and wherein the third texture is rougher than the second texture.

9. The garment according to claim 1, wherein the one or more ridges associated with the second texture comprise perpendicular ridges positioned substantially perpendicular to a flow pattern of the oncoming fluid.

10. The garment according to claim 9, wherein the one or more ridges associated with the third texture comprise perpendicular ridges positioned substantially perpendicular to a flow pattern of the oncoming fluid.

11. The garment according to claim 1, wherein the garment comprises a sock.

12. The garment according to claim 11, wherein the panel forms at least a portion of a cuff of the sock.

13. The garment according to claim 11, wherein the sock is selected from the group consisting of: a quarter-length sock, a crew-length sock, a calf-length sock, and a knee-length sock.

14. The garment according to claim 11, wherein the sock extends to a maximum length about 320 mm above the lateral malleolus of a wearer.

15. The garment according to claim 11, wherein the sock extends to a maximum length between 51 mm and 320 mm above the lateral malleolus of a wearer.

16. The garment according to claim 1, wherein the garment comprises a headband.

17. The garment according to claim 1, wherein the garment comprises a wristband.

18. An athletic garment comprising:

a body configured to receive and substantially cover a foot;

a cuff connected to the body;

the cuff configured to substantially encircle at least a portion of a leg;

a drag-reducing panel connected to the cuff;

the drag-reducing panel including a rough region having a first surface texture, a second region having a second surface texture, and a third region having a third surface texture;

wherein the rough region is configured to transition a boundary layer of an oncoming flow from laminar flow to turbulent flow;

wherein the third surface texture is configured to maintain the turbulent boundary layer; and wherein at least one ridge associated with the third surface texture is wider than at least one ridge associated with the first surface texture.

19. The athletic garment of claim 18, wherein the drag-reducing panel is integrated with the cuff.

20. The athletic garment of claim 19, wherein at least one of the first surface texture, the second surface texture, and the third surface texture comprises a pattern woven into the cuff.

21. The athletic garment of claim 20, wherein the pattern comprises at least one of a straight horizontal ridge, a straight vertical ridge, a diagonal ridge, a vertical zig-zag ridge, or a nodule.

22. The athletic garment of claim 20, wherein the rough region comprises at least one ridge positioned substantially perpendicular to the oncoming flow.

23. The athletic garment of claim 22, wherein the second surface texture is configured to maintain the boundary layer as laminar flow.

24. The athletic garment of claim 23, wherein the second surface texture comprises at least one ridge positioned substantially parallel with the oncoming flow.

25. The athletic garment of claim 23, wherein the third region is adjacent to the rough region.

26. The athletic garment of claim 25, wherein the at least one ridge associated with the third surface texture comprises a plurality of deep ridges positioned substantially perpendicular to the oncoming flow.

27. The athletic garment of claim 18, wherein the athletic garment comprises a sock.

28. The athletic garment according to claim 27, wherein the sock is selected from the group consisting of: a quarter-length sock, a crew-length sock, a calf-length sock, and a knee-length sock.

29. The athletic garment according to claim 27, wherein the sock extends to a maximum length about 320 mm above the lateral malleolus of a wearer.

30. The athletic garment according to claim 27, wherein the sock extends to a maximum length between 51 mm and 320 mm above the lateral malleolus of a wearer.

31. The athletic garment according to claim 18, wherein the cuff does not extend above the knee of a wearer.

* * * * *